US007667379B2

(12) United States Patent
Kaufman et al.

(10) Patent No.: US 7,667,379 B2
(45) Date of Patent: Feb. 23, 2010

(54) INDUSTRIAL HOLLOW CATHODE WITH RADIATION SHIELD STRUCTURE

(75) Inventors: Harold R. Kaufman, LaPorte, CO (US); James R. Kahn, Ft. Collins, CO (US)

(73) Assignee: Kaufman & Robinson, Inc., Ft. Collins, CO (US)

( * ) Notice: Subject to any disclaimer, the term of this patent is extended or adjusted under 35 U.S.C. 154(b) by 794 days.

(21) Appl. No.: 11/339,783

(22) Filed: Jan. 25, 2006

(65) Prior Publication Data

US 2006/0132017 A1 Jun. 22, 2006

Related U.S. Application Data

(63) Continuation-in-part of application No. 10/463,908, filed on Jun. 17, 2003, now abandoned.

(60) Provisional application No. 60/392,187, filed on Jun. 27, 2002.

(51) Int. Cl.
*F03H 1/00* (2006.01)

(52) U.S. Cl. ..... 313/359.1; 313/362.1; 313/231.31; 313/15

(58) Field of Classification Search ..... 313/359.1, 313/362.1, 231.31, 231.41, 15; 250/423 R, 250/426, 429, 493.1, 496.1, 498.1, 515.1
See application file for complete search history.

(56) References Cited

U.S. PATENT DOCUMENTS 4,218,633 A * 8/1980 Mirtich et al. ..... 313/362.1
4,296,330 A * 10/1981 Thomson et al. ..... 250/504 R
4,461,970 A * 7/1984 Anderson ..... 313/240
4,800,281 A * 1/1989 Williamson ..... 250/427
4,862,032 A * 8/1989 Kaufman et al. ..... 313/359.1
5,359,254 A * 10/1994 Arkhipov et al. ..... 313/15
5,587,093 A 12/1996 Aston ..... 219/121.48
5,898,178 A * 4/1999 Bunker ..... 250/423 R
6,380,685 B2 4/2002 Patterson et al. ..... 315/111.21

* cited by examiner

*Primary Examiner*—Joseph L Williams
*Assistant Examiner*—Kevin Quarterman
(74) *Attorney, Agent, or Firm*—Dean P. Edmundson

(57) ABSTRACT

In accordance with one embodiment of the present invention, the hollow-cathode apparatus comprises a small-diameter tantalum tube with a plurality of tantalum-foil radiation shields, wherein the plurality of shields in turn comprise one or more spiral windings external to that tube and approximately flush with the open end from which electron emission takes place. The axial length of at least one of the inner windings (closer to the tantalum tube) is equal to or less than approximately half the length of the tantalum tube. An enclosed keeper surrounds the cathode. To start the cathode, a flow of ionizable inert gas, usually argon, is initiated through the cathode and out the open end. An electrical discharge is then started between the keeper and the hollow cathode. When heated to operating temperature, electrons exit from the open end of the hollow cathode.

12 Claims, 7 Drawing Sheets

INDUSTRIAL HOLLOW CATHODE WITH RADIATION SHIELD STRUCTURE

CROSS-REFERENCE TO RELATED APPLICATION

This application is a continuation-in-part of our application Ser. No. 10/463,908, filed Jun. 17, 2003, now abandoned, which claims priority from Provisional Application No. 60/392,187, filed Jun. 27, 2002.

FIELD OF INVENTION

This invention relates generally to hollow cathodes, and more particularly it pertains to hollow cathodes used to emit electrons in industrial applications.

BACKGROUND ART

Hollow cathodes are used to emit electrons in a variety of industrial applications. As described in a chapter by Delcroix, et al., in Vol. 35 of *Advances in Electronics and Electron Physics* (L. Marton, ed.), Academic Press, New York (1974), beginning on page 87, there are both high and low pressure regimes for hollow-cathode operation. In the high-pressure regime, the background pressure (the pressure in the region surrounding the hollow cathode) approaches or exceeds 1 Torr (130 Pascals) and no internal flow of ionizable working gas is required for operation. In the low-pressure regime with a background pressure below 0.1 Torr, an internal flow of ionizable working gas is required for efficient operation. It is for operation in the low-pressure regime below 0.1 Torr, and usually below 0.01 Torr, that the present invention is intended.

An important industrial application of low-pressure hollow cathodes is for electron emission in ion sources. These ion sources are of both gridded and gridless types. The ions generated in gridded ion sources are accelerated electrostatically by the electric field between the grids. Gridded ion sources are described in an article by Kaufman, et al., in the *AIAA Journal*, Vol. 20 (1982), beginning on page 745. The particular sources described in this article use a direct-current discharge to generate ions. It is also possible to use electrostatic ion acceleration with a radio-frequency discharge, in which case the only electron emitting requirement would be for a neutralizer cathode.

In gridless ion sources the ions are accelerated by the electric field generated by an electron current interacting with a substantial magnetic field in the discharge region, i.e., a magnetic field with sufficient strength to make the electron-cyclotron radius much smaller than the length of the discharge region to be crossed by the electrons. The closed-drift ion source is one type of gridless ion source and is described by Zhurin, et al., in an article in *Plasma Sources Science & Technology*, Vol. 8, beginning on page R1, while the end-Hall ion source is another type of gridless ion source and is described in U.S. Pat. No. 4,862,032—Kaufman, et al.

There are different types of low-pressure hollow cathodes. The simplest is a refractory-metal tube, usually of tantalum. This type is described in the review by Delcroix, et al., in the aforesaid chapter in Vol. 35 of *Advances in Electronics and Electron Physics*. For hollow cathodes of the sizes, electron emissions, and gas flows of most interest herein, the lifetime of these simple cathodes is limited to a few tens of hours.

Another type of hollow cathode has been developed for electric thrusters used in space propulsion and is described in a chapter by Kaufman in Vol. 36 of *Advances in Electronics and Electron Physics* (L. Marton, ed.), beginning on p. 265.

The distinguishing feature of this type is an emissive insert that emits electrons at a lower temperature than does the plain metal-tube of the first type. The major advantage of this type is the long lifetime that is possible, of the order of 10,000 hours. The major disadvantage is the sensitivity of the supplemental emissive material to contamination. The emissive insert incorporates the supplemental emissive material that starts out as a carbonate (most often barium carbonate) and becomes an oxide when it is initially heated, or conditioned, for operation. If it is exposed to air after operation, the oxide combines with the water vapor in the air to become a hydroxide, which is much less effective as an emission material. Repeated exposure to air is not a problem in the space electric-propulsion application for which these cathodes were originally designed, but is much more serious in industrial applications.

A hollow cathode for industrial applications should have an operating lifetime of at least several hundred hours and be insensitive to repeated exposures to atmosphere between periods of operation. Shorter lifetimes than several hundred hours would be a problem because the time between maintenance in many industrial applications would then be limited by the cathode lifetime. While longer lifetimes might be of interest for industrial hollow cathodes, the time between maintenance would probably still be limited by other system components. In other words, the cost of a longer-lifetime hollow cathode, together with any special care and handling required, would have to be balanced against the replacement cost of a new hollow cathode of a simpler type.

The refractory metal tube of Delcroix, et al., in the aforesaid chapter in Vol. 35 of *Advances in Electronics and Electron Physics* is simple and, made of a metal such as tantalum, can stand repeated exposures to atmosphere between periods of operation. Its major shortcoming is a short lifetime. The space-propulsion hollow cathode described by Kaufman in the aforesaid chapter in Vol. 36 of *Advances in Electronics and Electron Physics* has a more than adequate lifetime, but is more complicated and more expensive, both to make and to use. For operation with frequent exposures to atmosphere, it is best to keep an inert gas flowing through such a cathode during atmospheric exposures to prevent degradation of the low-work-function, low-temperature emissive material. Even then, contamination from various gases used in the industrial application will probably limit the lifetime to far less than would be obtained in a space environment.

What might be called a compromise of the two types of hollow cathodes has been used in industrial applications. In this type, an emissive insert is used, but this insert consists only of tantalum foil. The lifetime is not as long without a low-work-function emissive material such as barium carbonate, but the tantalum-foil insert is less sensitive to atmospheric exposure than an insert that depends on the addition of an emissive material. Even with the reduced sensitivity to atmospheric exposure, a common mode of failure is oxidation of the tantalum foil and having it break into flakes, eventually clogging the flow passage through the tantalum-foil insert.

Another example of possible hollow-cathode configurations is U.S. Pat. No. 5,587,093. There is described a hollow cathode with multiple radiation shields surrounding a tube through which the working gas is introduced. However, there are intervening support structures between both the tube and the inner radiation shield and between the inner and outer radiation shields. These support structures permit a large fraction of the escaping heat to be conducted by the support structures around the ends of the radiation shields, thereby degrading the effectiveness of the radiation shields. Aston also uses an electrically heated emissive insert, a component not used in the present invention.

SUMMARY OF INVENTION

In light of the foregoing, it is a general object of the invention to provide a hollow cathode that is simple to fabricate and use, while having a long operating lifetime.

Another general object of the invention is to provide a hollow cathode that has a long operating lifetime while using a robust metallic part as the emissive surface.

A further general object of the invention is to provide a hollow cathode that has a long operating lifetime while using a refractory-metal tube with a small diameter, where the inside diameter either approaches the diameter of the emissive surface, or is equal to it. The small tube carries away less heat than a large tube and therefore requires less power to reach operating temperature.

A specific object of the invention is to provide a hollow cathode with an operating lifetime of at least several hundred hours that does not require conditioning before operation.

Another specific object of the invention is to provide a hollow cathode, with an operating lifetime of at least several hundred hours, that does not degrade significantly due to atmospheric exposure between periods of operation.

A further specific object of the invention is to provide a hollow cathode with an operating lifetime of at least several hundred hours that does not incorporate a supplemental emissive material.

Yet another specific object of the invention is to provide a hollow cathode with an operating lifetime of at least several hundred hours that is readily fabricated of materials that have minimal reaction with atmosphere when exposed thereto.

Still another specific object of the invention is to provide a hollow cathode with an operating lifetime of at least several hundred hours that does not require a metallic resistive heater for starting.

In accordance with one embodiment of the present invention, the hollow-cathode apparatus comprises a small-diameter tantalum tube with a plurality of tantalum-foil radiation shields, wherein the plurality of shields in turn comprise one or more spiral windings external to that tube and approximately flush with the open end from which electron emission takes place. The axial length of at least one of the inner windings (closer to the tantalum tube) is equal to or less than approximately half the length of the tantalum tube. An enclosed keeper surrounds the cathode. To start the cathode, a flow of ionizable inert gas, usually argon, is initiated through the cathode and out the open end. An electrical discharge is then started between the keeper and the hollow cathode. When heated to operating temperature, electrons exit from the open end of the hollow cathode.

DESCRIPTION OF FIGURES

Features of the present invention which are believed to be patentable are set forth with particularity in the appended claims. The organization and manner of operation of the invention, together with further objectives and advantages thereof, may be understood by reference to the following descriptions of specific embodiments thereof taken in connection with the accompanying drawings, in the several figures of which like reference numerals identify like elements and in which:

DESCRIPTION OF PRIOR ART

Figure 1:
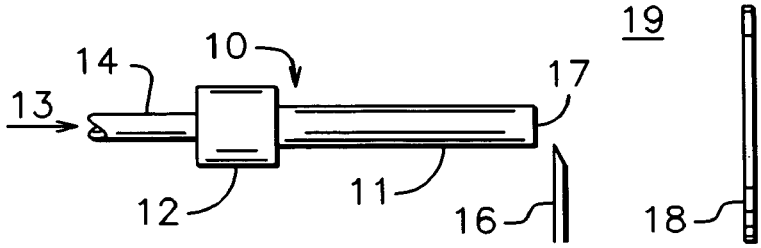
(PRIOR ART) Fig. 1
FIG. 1 is a prior-art hollow-cathode assembly.

Referring to FIG. 1, there is shown prior-art hollow-cathode assembly 10 of the type described by Delcroix, et al., in the aforesaid chapter in Vol. 35 of *Advances in Electronics and Electron Physics*. The hollow cathode is tube 11, fabricated of a refractory metal. Possible refractory metals include molybdenum, niobium, rhenium, tantalum, tungsten, or alloys of these metals, with tantalum the most common choice. Carbon is a refractory material that has also been used and is considered either a metal or nonmetal, depending on the particular field of study. Cathode holder 12 supports hollow cathode 11, as well as conducting ionizable working gas 13 which is supplied to the cathode holder through feed tube 14. Igniter/keeper electrode 16 is located near open end 17 of hollow cathode 11. Further from open end 17 is anode 18. Hollow-cathode assembly 10 operates in surrounding volume 19.

Figure 2:
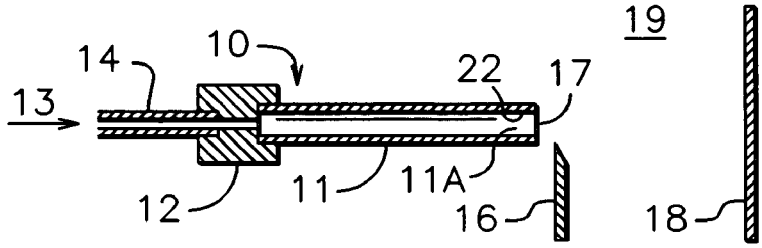
(PRIOR ART) Fig. 2
FIG. 2 shows a cross section of the prior-art hollow-cathode assembly of FIG. 1.

A cross section of the prior-art hollow-cathode assembly of FIG. 1 is shown in FIG. 2. The operation of interest herein is what Delcroix, et al., refer to as a hollow cathode arc (HCA), with the potential difference between the anode and cathode $\leqq 50$ V. Further, it is in the low-pressure regime in which the background pressure, the pressure in surrounding volume 19, is $\leqq 0.1$ Torr ($\leqq 13$ Pascals). It is apparent to one skilled in the art that this low operating pressure also requires the use of a vacuum pump and a vacuum chamber enclosing volume 19, both of which are not shown in FIG. 1 or 2.

To obtain normal operation (≦50 V) in the low-pressure regime, it is necessary to supply a sufficient flow of ionizable working gas 13 to the hollow cathode so that the pressure in volume 11A, within and near the open end of cathode 11, is of the order of one Torr. Electrons are created by ionization of atoms or molecules of the ionizable working gas, but a major part of the electron emission from the hollow cathode comes from surface 22 inside the open end of the hollow cathode. This emission includes secondary electrons from ion bombardment, as well as enhanced emission due to high electric fields, but is primarily thermionic in nature. A thermionic-emission temperature near the open end of the hollow cathode is required for this emission.

The significance of this nearly constant maximum temperature may not be apparent to someone unskilled in the art. In the case of a hollow cathode, the surface temperature required for thermionic emission is maintained primarily by ion bombardment. If the emission is low, the discharge voltage rises, increasing the energy of the bombarding ions and thereby increasing the surface temperature. Conversely, if the emission is high, the discharge voltage decreases, decreasing the energy of the bombarding ions and thereby decreasing the surface temperature. In this manner, controlling to a given emission results in the discharge voltage varying to maintain the emission surface within a narrow temperature range. In addition, thermionic electron emission varies extremely rapidly with emitter temperature, which means that a wide range of electron emissions corresponds to a narrow range of emission-surface temperatures. The net result is that, for a given emission-surface material, there will be a narrow range of emitter temperature for a wide range of operating conditions and configuration. For tantalum, that temperature is about 2400 K.

Figure 3:
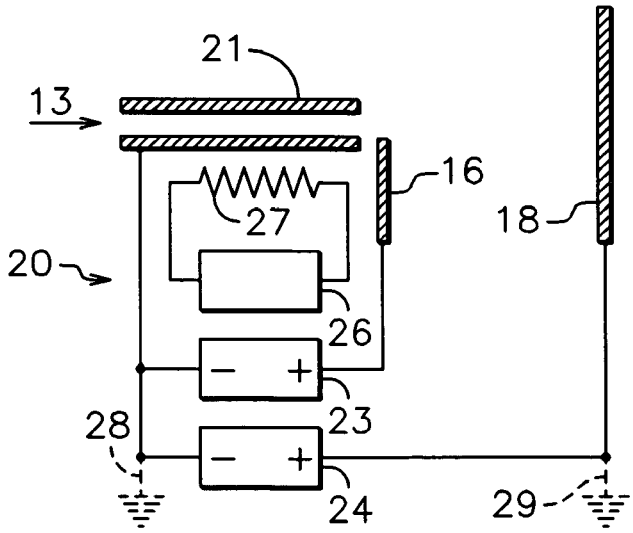
(PRIOR ART) Fig. 3
FIG. 3 shows a prior-art electrical circuit diagram of a hollow cathode.

Referring to FIG. 3, there is shown prior-art electrical circuit diagram 20 for a hollow cathode. Igniter/keeper power supply 23 provides a positive potential to the igniter/keeper electrode 16 relative to cathode 21. Note that cathode 21 may be prior-art hollow cathode 11 or some other hollow cathode. When electrode 16 is functioning as an igniter, a high voltage of at least several hundred volts and usually of the order of 1 kV is supplied by power supply 23 to initiate the discharge. The requirement for a voltage of at least several hundred volts results from the need to generate an electrical breakdown in the ionizable working gas, which results from imposing a voltage greater than the Paschen-law minimum, which varies with the working gas used but ranges from about 400-600 V. After the discharge is started, a sustaining keeper discharge of ≦50 V and ≧1 A can be used. Electrode 16 and power supply 23 can thus act as igniter and igniter power supply, keeper and keeper supply, or both.

Still referring to FIG. 3, discharge power supply 24 provides a positive potential to anode 18 relative to hollow cathode 21, causing a discharge current to the anode which consists primarily of electrons emitted by hollow cathode 21 and arriving at the anode. In normal operation the discharge is ≦50 V with a current of several amperes or more. Power supply 24 may also incorporate a high-voltage starting circuit of at least several hundred volts and usually of the order of 1 kV. If there is such a starting circuit in power supply 24, igniter/keeper electrode 16 and igniter/keeper power supply 23 could be omitted. Anode 18 is shown in cross section as being made of metal, which is often the case. The anode may also be the entire vacuum chamber, instead of an electrode within it. When used with an ion source, the anode may be the quasi-neutral plasma of an ion beam, i.e., not a metallic electrode.

Heater power supply 26 energizes resistive heater 27 to bring hollow cathode 21 to operating temperature. This power supply may be of either the direct or alternating current type. When a metallic resistive heater is used, radiation shields may surround the resistive heater to reduce the electrical power required for the hollow cathode to reach operating temperature. If the cathode is heated to operating temperature by igniter/keeper supply 23, power supply 26 and resistive heater 27 could be omitted.

Different ground connections may be used. The surrounding vacuum chamber is typically defined as ground potential and is often, but not always, at earth ground. If the cathode is at the potential of the surrounding vacuum chamber, the ground connection would be as shown by ground 28. If the anode is the surrounding vacuum chamber, the ground connection would be as shown by ground 29. In the latter case, electrical isolation would be required in the gas line which, far from the cathode, would also be at ground potential. The techniques for such electrical isolation are well known to those skilled in the art and are not pertinent to the present invention.

The preceding description of the electrical circuit diagram of FIG. 3 should make clear that a variety of electrical circuit options are possible. Regardless of the particular options selected, the electrical circuit must initiate the discharge from the hollow cathode, with the heating to operating temperature provided either prior to the initiation of discharge or during that initiation. If the heating is prior to the initiation of the discharge, a maximum of several hundred Volts will usually be sufficient for this initiation, rather than the previously mentioned ~1 kV. Following the initiation of the discharge, a normal discharge is sustained at ≦50 V. This sustained discharge can be directly to the anode, or it can be to a keeper electrode. In the latter case, a pre-existing discharge to the keeper can provide rapid initiation of a normal discharge to an anode, without a large potential being applied to that anode. In this sense, the keeper discharge "keeps" the cathode ready for normal operation.

The simple tubular cathode of Delcroix, et al., has a limited lifetime, typically a few tens of hours in the sizes and operating conditions of interest for ion sources. Delcroix, et al., do not discuss the effect of working gas on lifetime, but the use of an inert gas such as argon, krypton, or xenon would be required to reach even this limited lifetime. A reactive gas such as oxygen or nitrogen would result in shorter lifetimes. (Nitrogen is considered inert in many applications, but is reactive in the environment of an electrical discharge.)

As a measure of tubular-cathode lifetime at operating conditions of interest, a tantalum tube 1.57 mm in diameter and 38 mm long, with a wall thickness of 0.38 mm was operated with an argon gas flow of 10 sccm (standard cubic centimeters per minute). The igniter/keeper current was 1.5 A (power supply 23 in FIG. 3) and the emission was 5 A (power supply 24 in FIG. 3). The pressure in surrounding volume 19 was less than 0.001 Torr. A cathode assembly with an enclosed keeper was used, similar to that to be discussed in connection with FIGS. 6 and 7. This hollow cathode was operated with an ion source that was generating an ion beam. The ion beam and surrounding plasma constituted the anode for the discharge. The closest measurement to the discharge voltage was the igniter/keeper supply (power supply 23, which was 16-17 V over most of the life test). Operation was periodically interrupted for wear measurements. The limit in lifetime was reached when the cathode could not be restarted at a gas flow of 43 sccm (more than four times the operating gas flow). Because the interruptions near the end of life were about once every 24 hours, with several hours for measurements, pump-down, etc., the uncertainty in lifetime is about ±20 hours. The operating lifetime was about 60 hours for the simple tubular cathode at these conditions. While such a lifetime may be adequate for some applications, it is very short for the electron emission functions of many industrial ion sources.

On the positive side, exposure to atmosphere had no observable adverse effect on the simple tubular cathode. While adsorbed water vapor might be expected to form an oxide layer during any subsequent operation, the thickness of this layer will be small compared to any reasonable tube thickness, hence should easily be removed during the subsequent operation.

The use of radiation shields is discussed by Delcroix, et al., in the aforesaid chapter in Vol. 35 of *Advances in Electronics and Electron Physics*. The use of two cylindrical radiation shields is shown in the figure on page 147 and the discussion on pages 145-146 therein to result in a drop in discharge voltage from about 44 V to about 35 V. While Delcroix, et al., find this drop worth noting, there is no indication of a possible effect on lifetime. On pages 147-148 therein, the total radiation from an unshielded cathode is estimated at 15-20% of the total discharge power. While this result is also worth noting, there is again no indication of a possible qualitative effect on lifetime that can be obtained by reducing radiation losses.

To obtain a lifetime for the double-shielded configuration described above, a 1.57-mm-diameter, 38-mm-long hollow cathode (similar to that described above) was operated with two concentric cylindrical tantalum shields having outside diameters of 9.5 mm and 3.18 mm. The thicknesses of these shields were approximately the same 0.38-mm thickness as the tantalum tube. Using the same operating conditions as were used for the simple tantalum tube hollow cathode, the initial keeper voltage was 13-14 V, significantly lower than the 16-17 V obtained with the simple tubular cathode and in agreement with the reduced operating voltage described by Delcroix, et al. However, the keeper voltage increased more rapidly than was observed with the simple tubular cathode and there was no increase in operating lifetime over that cathode.

Figure 4:
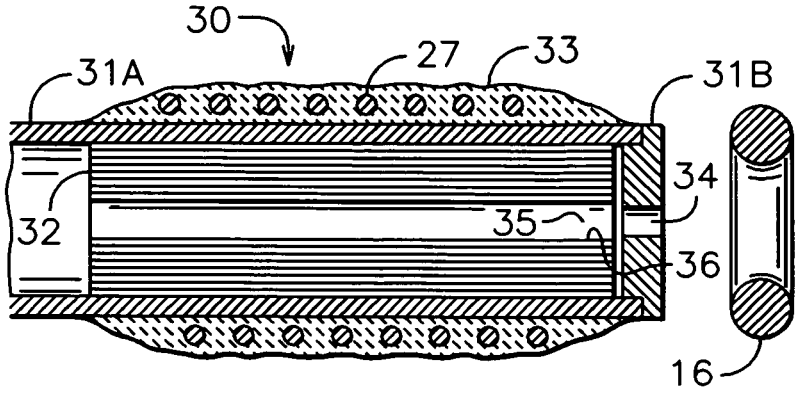
(PRIOR ART) Fig. 4
FIG. 4 shows a cross section of another prior-art hollow cathode.

Referring to FIG. 4, there is shown a cross section of another prior-art hollow cathode, the space-propulsion hollow cathode described by Kaufman in the aforesaid chapter in Vol. 36 of *Advances in Electronics and Electron Physics*. Cathode 30 has a cathode body that is comprised of tantalum tube 31A electron-beam welded to tungsten tip 31B. Inside the tantalum tube and also part of the hollow cathode is rolled tantalum-foil insert 32. (The tantalum foil from which the insert is fabricated is 0.013 mm thick.) The foil in this insert was coated with a low-work-function, low-temperature emissive material, barium carbonate, which becomes barium oxide during initial heating or conditioning of the cathode. Outside the tantalum tube and also part of the hollow cathode is resistive heater 27 imbedded in flame-sprayed alumina 33. Igniter/keeper 16 is spaced from the open end of the cathode and has an annular shape.

Hollow cathode 30 is brought to approximately operating temperature when resistive heater 27 is energized by a heater power supply (see power supply 26 in FIG. 3). With a flow of ionizable working gas (mercury vapor in this case), a discharge is initiated by a positive voltage of several hundred volts on igniter/keeper electrode 16 relative to cathode body 31A/31B. This discharge is then sustained by a 1-2 A current to igniter/keeper electrode 16. The electron emission is through aperture 34, which is reduced in diameter from the inside diameter of tantalum tube 31A. The electrons that pass through the aperture come from volume 35 adjacent to the aperture, and are believed to mostly originate from internal insert surface 36 adjacent to volume 35. The lower cathode tip temperature (1400-1500 K) of this cathode type compared to that of the configuration in FIGS. 1 and 2 is attributed to the lower work function of the oxide-coated insert.

As described by Nakanishi, et al., in an article in *Journal of Spacecraft and Rockets*, Vol. 11, beginning on page 560, operating lifetimes of the order of 10,000 hours have been demonstrated with the type of hollow cathode shown in FIG. 4. However, exposure to atmosphere rapidly degraded the electron emission characteristics of the emission material—see Zuccaro in *AIAA Paper* 73-1140, 1973. This degradation was not observed with storage in either an inert gas (argon) or a vacuum.

The use of electrode 16 as a keeper electrode permitted electron emission to be available for the subsequent initiation of ion-source operation without having to make that initiation simultaneous with starting the hollow cathode. For example, it was desirable to have the neutralizer hollow cathode ready to emit electrons before an ion beam is initially accelerated, and not to generate an unneutralized ion beam with the attendant high accelerator-grid impingement while the neutralizer hollow cathode was started.

Figure 5:
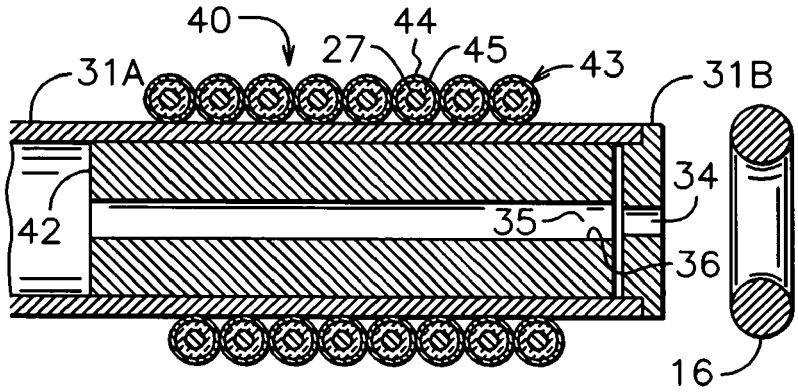
(PRIOR ART) Fig. 5
FIG. 5 shows a cross section of yet another prior-art hollow cathode.

Referring to FIG. 5, there is shown yet another prior-art hollow cathode, a space-propulsion hollow cathode described by Zuccaro in the aforementioned *AIAA Paper* 73-1140, 1973. Hollow cathode 40 differs from the one shown in FIG. 4 in having porous-tungsten insert 42 in place of rolled-foil insert 32. The pores of the porous tungsten are impregnated with an emissive material, barium carbonate. Another difference is that resistive heater 27 is enclosed in swaged composite structure 43 consisting of an outer metal tube 44, resistive heater 27, and insulator 45 between the two.

The operation of hollow cathode 40 is similar in all important aspects to that of hollow cathode 30 described in connection with FIG. 4, including degradation of the emission material due to exposure to atmosphere. The function and performance of the rolled-foil insert are similar to those of the porous-tungsten insert, with both serving as long-duration dispensers of emissive material. (Porous-nickel inserts impregnated with emissive material have been used elsewhere with similar results.) Reliability of resistive heater 27 has been an recurrent problem with both designs.

The space-propulsion hollow cathodes shown in FIGS. 4 and 5 are from publications that are several decades old. However, more recent space-propulsion hollow cathodes are similar, as shown by U.S. Pat. No. 6,380,685—Patterson, et al.

Figure 6:
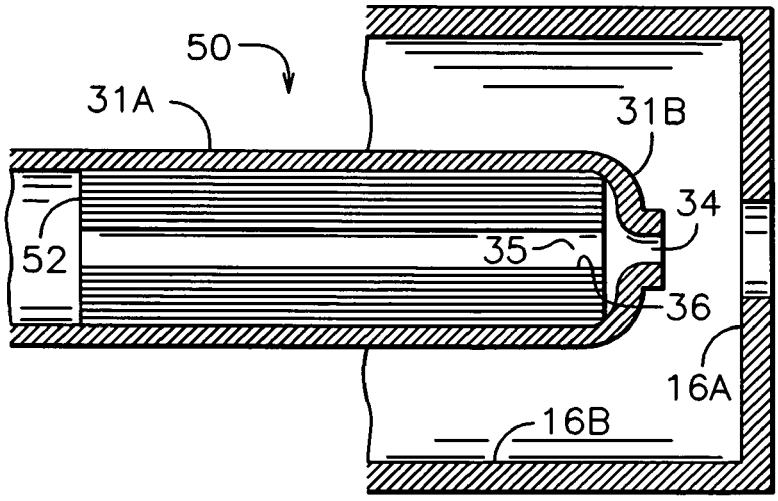
(PRIOR ART) Fig. 6
FIG. 6 shows a cross section of still another prior-art hollow cathode.

Referring to FIG. 6, there is shown a cross section of still another prior-art hollow cathode. This type of hollow cathode is the compromise mentioned in the Background Art section and has been marketed as the HCES 1000 and HCES 5000 by Commonwealth Scientific Corporation and more recently by Veeco Instruments Inc. The cathode body is comprised of tantalum tube 31A and tip 31B and is formed by swaging a tantalum tube to a small diameter at the open end. Although the cathode body is fabricated in a different manner than the cathode bodies of prior-art hollow cathodes 30 and 40, the functions of all three are the same. Rolled tantalum-foil insert 52 is similar to insert 32 in FIG. 4, except that no additional emissive material is used on insert 52. The igniter/keeper has apertured end 16A and cylindrical wall 16B and is of an enclosed design.

Figure 7:
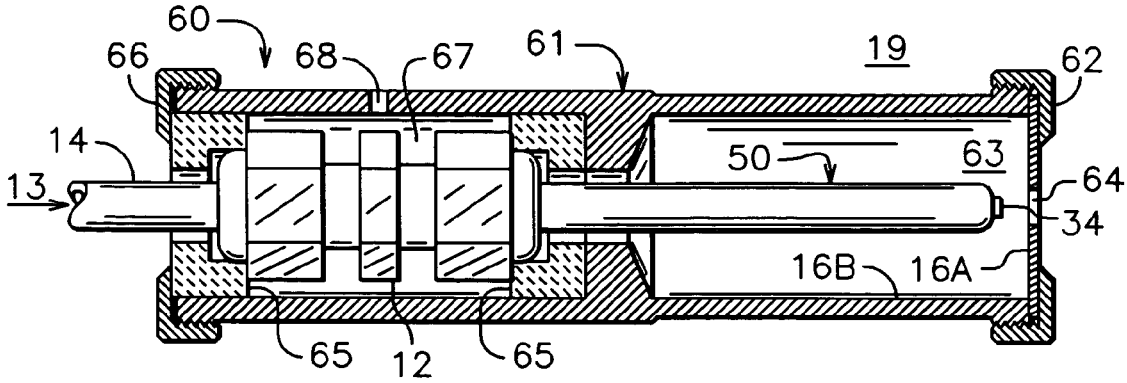
(PRIOR ART) Fig. 7
FIG. 7 shows a cross section of a prior-art hollow-cathode assembly incorporating the hollow cathode shown in FIG. 6.

The enclosed keeper can be better understood by reference to FIG. 7, where hollow cathode 50 is incorporated in hollow-cathode assembly 60. Hollow cathode 50 is assembled within main body 61, one end of which forms igniter/keeper cylindrical wall 16B. Apertured end 16A is a separate part that is held in contact with cylindrical wall 16B by screw fitting 62. Main body 61, cylindrical wall 16B, and apertured end 16A enclose volume 63. Cathode holder 12 in this design is a union fitting between tantalum tube 31A and feed tube 14. Cathode holder 12 is separated from and positioned relative to main body 61 by insulators 65. Cathode holder 12 and insulators 65 are held in position in main body 61 by screw fitting 66. Volume 67 adjacent to cathode holder 12 is vented to surrounding volume 19 by vent hole 68.

From a functional viewpoint, an enclosed keeper is defined as one in which most of the ionizable working gas from the hollow cathode must pass through the keeper aperture (64 in FIG. 7). In contrast, an ordinary or non-enclosed keeper permits much or most of the ionizable working gas to flow around the outside of the keeper (see igniter/keeper 16 in FIG. 4 or 5).

The discharge with an enclosed keeper is started by applying a positive potential of the order of 1 kV to main body 61 (including igniter/keeper 16A/16B) relative to cathode body 31A/31B. The ionizable working gas enters volume 63 through cathode aperture 34 and leaves through igniter/keeper aperture 64, so that the pressure in volume 63 is intermediate of the pressure in cathode aperture 34 and surrounding volume 19. Because of the intermediate pressure in volume 63, the starting discharge is concentrated in this volume, thereby heating hollow cathode 50 to approximately operating temperature while starting the discharge. That is, a discharge between cathode 50 and igniter/keeper 16A/16B is the heating means to bring cathode 50 to operating temperature. After the discharge is started to the igniter/keeper, the current to the igniter/keeper is maintained at about 1.5 A, which corresponded to a cathode-keeper voltage ≦50 V and is usually in the 20-30 V range.

The electrical circuit diagram for operating cathode assembly 60 is similar to that shown in FIG. 3. Hollow-cathode assembly 60 replaces hollow cathode 21 and igniter/keeper electrode 16. Because the cathode heating is provided by igniter/keeper power supply 23, power supply 26 and resistive heater 27 are not required. Operation is completed by using discharge power supply 24 to cause the electron emission to the anode.

The lack of an additional emissive material on rolled tantalum-foil insert 52 (FIG. 6) has both adverse and beneficial effects. The operating lifetime is reduced from thousands of hours to several hundred hours. The adverse effect of atmospheric exposure is also reduced. With no oxide to degrade into a hydroxide, this degradation is less severe. Repeated exposure of the foil insert to atmosphere, however, still results in embrittlement and flaking of the foil insert, with the flakes eventually plugging the central passage in the insert through which the ionizable working gas flows. The embrittlement and flaking is believed due to adsorbed layers of water vapor accumulated during atmospheric exposure on the extended surface area of the rolled foil insert.

To summarize the prior art of hollow cathodes, the simple tubular hollow cathode of Delcroix, et al., withstands exposure to atmosphere very well, but it has a very short lifetime. The space electric-propulsion hollow cathodes, with an insert coated or impregnated with emissive material, can have extremely long lifetimes, but cannot withstand repeated exposure to atmosphere. The compromise hollow cathode with a rolled-foil insert that has no additional emissive material has an acceptable lifetime if the exposure to atmosphere is minimal. With repeated exposure, the rolled-foil insert also fails.

Another example of possible hollow-cathode configurations is the aforementioned U.S. Pat. No. 5,587,093—Aston. There is described an arc channel electrode in which an inner radiation shield, radiation shield 24, is positioned around the downstream end of body/return current tube 14, which in turn is positioned inside of arc channel electrode 33. An outer radiation shield, radiation shielding [sic] 45, is positioned outside of arc channel electrode 33. The inner and outer radiation shields are not adjacent to each other because there is intervening support structure (arc channel electrode 33) between the inner and outer radiation shields. Such intervening support structure permits a large fraction of the escaping heat to be conducted by the support structure around the ends of the outer radiation shield, thereby greatly degrading the effectiveness of the outer shield. Further, in Aston the radiation shields are not supported by the hollow tube through which the working gas flows (gas inlet/input current tube 13), so that there is another intervening support structure between working-gas tube 13 and the inner radiation shield, further degrading the effectiveness of the radiation shields. Also, in the Aston device at the end of tube 13 and connected thereto is helix 20, which is the emissive insert of insert/heater/orifice plate 11. Helix 20 is electrically heated by currents through tubes 13 and 14. Radiation shield 24 is loosely wrapped around the downstream end of tube 14 "over a length commensurate with the general length of the insert/heater/orifice plate 11." The length of radiation shield 24 is not determined by a heat-loss mitigation protocol as in the present invention, but by the length of the electrically heated emissive insert (helix 20), a component that is not used in the present invention.

DESCRIPTION OF PREFERRED EMBODIMENT

Figure 8:
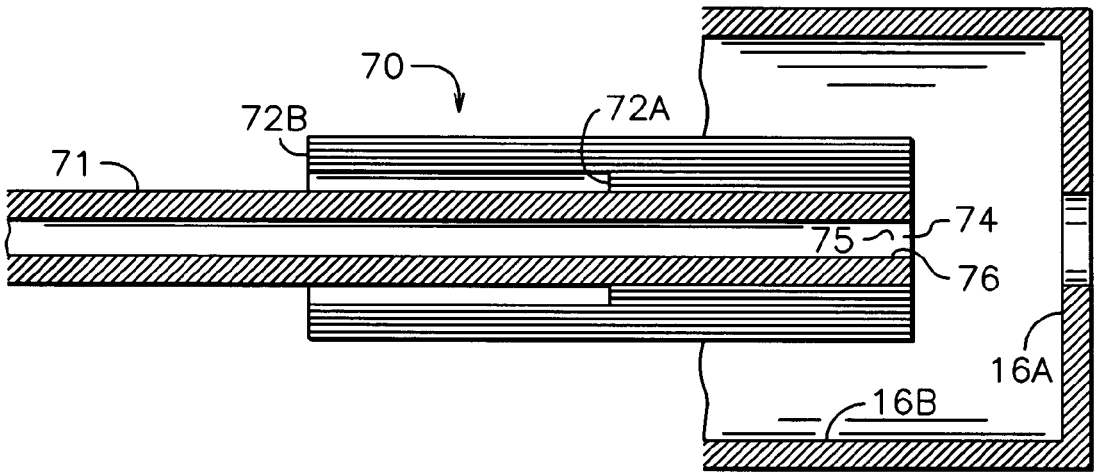
FIG. 8 is a cross section of an embodiment of the present hollow-cathode invention.

Referring to FIG. 8, there is shown the preferred embodiment of the present invention. Hollow cathode 70 comprises a hollow tantalum tube 71 and inner and outer radiation shields 72A and 72B. A shield is defined as a single layer that circumferentially encloses the hollow-cathode tube. Radiation shields 72A comprise a plurality of shields constructed of a spiral, multiple-turn winding of tantalum foil, wound external to the hollow cathode tube 71. Radiation shields 72B comprise a second plurality of shields, also constructed of a spiral, multiple-turn winding of tantalum foil, external to both hollow-cathode tube 71 and radiation shields 72A. Radiation shields 72A and radiation shields 72B are adjacent to each other and to tube 71, without the presence of intervening support structure between either any of the radiation shields or between tube 71 and any of the shields. The term "adjacent" as used herein means immediately preceding or following. "Support structure" refers to support from a source exterior to radiation shields 72A and 72B and tube 71. Refractory material (e.g. in the form of particulates) could be included between adjacent radiation shields, or between the inner shield and tube 71, and the presence of such refractory material is not considered to be intervening support structure in this invention. The ends of shields 72A and 72B are both approximately even with the open end of tube 71. Shields 72A and 72B are adjacent to each other The electrons that pass through aperture 74 come from volume 75 near the aperture, and mostly originate from internal tube surface 76 adjacent to volume 75. An enclosed keeper with apertured end 16A and cylindrical wall 16B is also shown in FIG. 8.

The electrons that pass through aperture 74 come from volume 75 near the aperture, and mostly originate from internal tube surface 76 adjacent to volume 75. An enclosed keeper with apertured end 16A and cylindrical wall 16B is also shown in FIG. 8.

Figure 9:
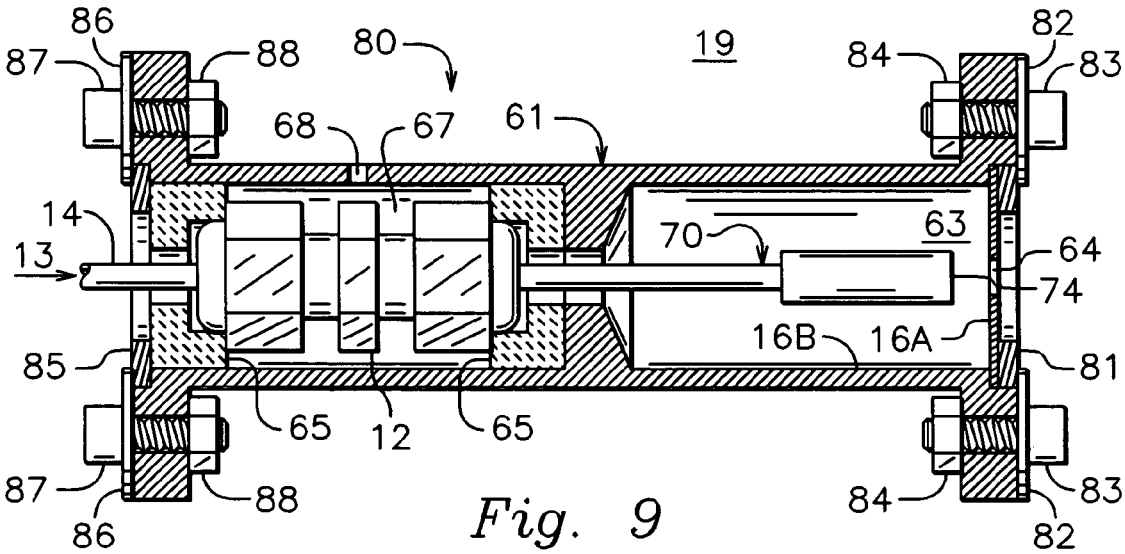
FIG. 9 shows a hollow-cathode assembly incorporating the preferred embodiment of the present invention shown in FIG. 8.

In FIG. 9, hollow cathode 70 is incorporated in hollow-cathode assembly 80. Hollow cathode 70 is assembled within main body 61, one end of which forms igniter/keeper cylindrical wall 16B. Apertured end 16A is a separate part that is held in contact with cylindrical wall 16B by retainer 81, which in turn is held in position by washers 82, screws 83, and nuts 84. Main body 61, cylindrical wall 16B, and apertured end 16A enclose volume 63. Cathode holder 12 is a union fitting between tantalum tube 71 and feed tube 14 and provides a support means for tantalum tube 71. Cathode holder 12 is separated from and positioned relative to main body 61 by insulators 65. Cathode holder 12 and insulators 65 are held in position in main body 61 by retainer 85, which in turn is held in position by washers 86, screws 87, and nuts 88. Volume 67 adjacent to cathode holder 12 is vented to surrounding volume 19 by vent hole 68.

Except for the replacement of cathode 50 in FIG. 7 with cathode 70 in FIG. 9, the startup sequence and electrical circuit diagram for hollow-cathode assembly 80 is similar to that for hollow-cathode assembly 60. That is, the heating means for the cathode (cathode 70 in this case) to reach operating temperature is a discharge between the cathode and igniter/keeper 16A/16B.

The difference in lifetime between the preferred embodiment and the prior-art hollow cathode of Delcroix, et al., is dramatic. The preferred embodiment of FIGS. 8 and 9 was tested with a tantalum tube 1.57 mm in outside diameter, 38 mm long, and with a wall thickness of 0.38 mm. Inner (closest to tube 71) radiation shields 72A were comprised of 15 turns of 0.013-mm-thick tantalum foil, with an axial length of 10 mm. Outer (farthest from tube 71) radiation shields 72B was also comprised of 15 turns of 0.013-mm-thick tantalum foil, but with an axial length of 20 mm. Before winding the outer radiation shields, the foil was dimpled by pressing it against 60-grit abrasive paper. The dimples produced in the foil reduced the contact area between adjacent shields when using the spiral-wound construction, thereby improving the efficiency of the plurality of radiation shields. The operating lifetime of the preferred embodiment was over 600 hours, more than ten times as long as the simple tubular configuration of Delcroix, et al. described in the Description of Prior Art section. Except for the addition of radiation shields 72A and 72B in the preferred embodiment, the operating conditions and configuration were identical for the lifetime test of the preferred embodiment and that described in the Description of Prior Art section—including the use of the same enclosed keeper configuration.

The keeper voltage was several volts lower at the beginning of the life test and several volts higher at the end, but it was 13-15 V over most of the lifetime. The increase in lifetime thus corresponded to only a small 2-3 V reduction in the discharge (keeper) voltage, indicating a highly nonlinear inverse relationship between discharge voltage and lifetime. The discharge voltage is closely related to the energy of the ions bombarding the end of the cathode and the internal emissive surface. From the large increase in lifetime that results from a small decrease in voltage, the ion energies are close to what is commonly called the sputtering threshold. Most significantly, this increase in lifetime was obtained with a robust 0.38-mm thickness for the emission surface, without recourse to either an additional emissive material or a fragile foil at this surface.

What is also unexpected is that the greatly improved lifetime was obtained with two pluralities of radiation shields: one that extended from the open end of the tantalum tube only about a quarter of the tube's length, and the other only about a half of the tube's length, as opposed to the approximately full-length plurality of shields described by Delcroix, et al. The advantage of the shorter radiation shields in the preferred embodiment can be understood by reference to FIGS. 10, 11*a*, and 11*b*.

Figure 10:
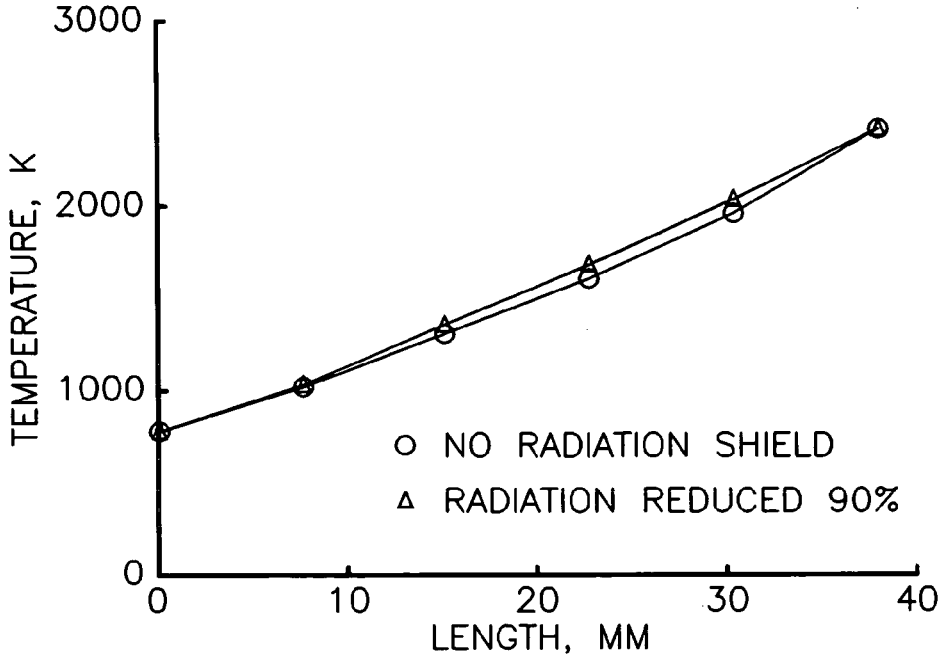
FIG. 10 shows temperature distributions over the length of a hollow cathode.

Referring first to FIG. 10, there is shown the calculated temperature distribution along a simple 38-mm-long tantalum tube hollow cathode similar to that described in the Description of Prior Art section. The radiation was calculated from the Stefan-Boltzmann radiation equation, using a typical thermal emissivity for the tube of 0.5. Those skilled in the art will recognize that convection is negligible compared to radiation in a vacuum environment. The enclosed keeper was at a temperature of about 500° C. and this temperature was used both as the background temperature for radiation from the tube and as the cathode holder temperature. The interior of the enclosed keeper was roughened from repeated use, as well as being considerably larger than the cathode tube, both of which justified an approximate thermal absorptivity of unity. The cathode length was divided into five segments, each of which radiated at a mean temperature for that segment. The conducted thermal energy between each adjacent pair of segments, and between the last segment and the holder, was calculated from the cross section of the tube, the difference in mean temperatures, and the thermal conductivity. Delcroix, et al., gave a maximum (thermionic-emission) temperature of about 2400 K, which was also used. Delcroix, et al., also showed that the peak temperature could occur at small distances from the open end. These small displacements of maximum temperature are of interest from a theory viewpoint but are not important for the thermal analysis herein, so that 2400 K was used as the temperature at the open end. Radiation from the open end, including the aperture, was estimated at 1.2 W, while the cooling effect of electron emission (1.5 A igniter/keeper and 5 A discharge) through the work function of the tantalum was 27.5 W.

Using the preceding assumptions, the temperature distribution shown by the circles in FIG. 10 was obtained, together with a total power loss of 108 W. Dividing the power loss by the total emission current of 6.5 A gives an estimated discharge voltage of 16.6 V, which is in excellent agreement with the 16-17 V observed over most of the cathode lifetime. This agreement supports the assumptions and calculation procedure used.

The next calculation shows that the use of radiation shielding did not greatly change the temperature distribution along the tantalum tube. In this calculation the assumptions were all the same as given above, except that the radiation loss was reduced by 90 percent. Such a large reduction would be difficult to obtain, so that the temperature distribution obtained should be a maximal departure from that with no radiation shielding. This calculation gave the temperature distribution shown by the triangles in FIG. 10, together with a total power loss of 77 W. Despite a 29 percent reduction in power loss, the two temperature distributions are nearly the same.

For thermionic electron emission to be the same for two configurations, the temperature of the electron emission surface near the tip must be approximately constant. The two temperature distributions in FIG. 10 differ by a maximum of about 80 K between the tip and the cathode holder and represent an extreme range from no shielding to the radiation loss being reduced by 90 percent, with a corresponding drop in required heating power from 108 W to 77 W. From the agreement of the two distributions, it should be apparent that, with or without radiation shielding, the temperature distribution from the cathode holder to the open end of the cathode tube will be approximately the same. In examining how to reduce the radiation loss, reduce the required discharge power, hence reduce the discharge voltage and increase lifetime, the temperature distribution in the cathode can be assumed roughly constant.

Figure 11A:
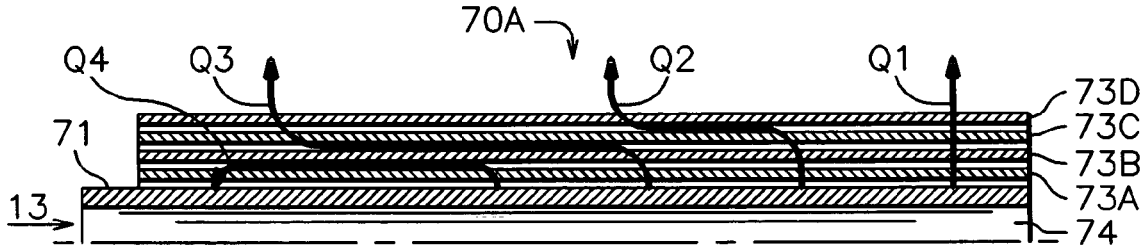
FIG. 11*a* shows the heat-loss distribution for full-length radiation shielding.

Referring to FIG. 11*a*, there is shown the cross section of hollow cathode 70A which is similar to that of the preferred embodiment 70 in FIG. 8, except that radiation shields 73A, 73B, 73C, and 73D all extend for approximately the full length of tantalum tube 71. To better show details, the radial distances are exaggerated. Because the radiation depends on ($T_{hot}^4 - T_{cold}^4$), the bulk of the radiation comes from the hottest portion of tantalum tube 71 near the open end (aperture 74). After the radiation reaches the radiation shields, the thermal conductivity of the radiation shields enables the heat to be conducted in the axial direction toward the cold end of the tantalum tube, as indicated by heat-transfer paths Q2 through Q4. (Heat-transfer path Q1 is shown as radial because some of the heat near the hot end must flow in a nearly radial direction.) This thermal conduction toward the cold end of the tantalum tubes has not been described in literature and results in a radiation shield being cooler than it would otherwise be. Because it is cooler, it receives more radiation near the hot end of the tantalum tube. Energy can even be radiated back to the tube near the cathode holder from inner radiation shield 73A, effectively providing a parallel path for the heat arriving at the cathode holder.

Figure 11B:
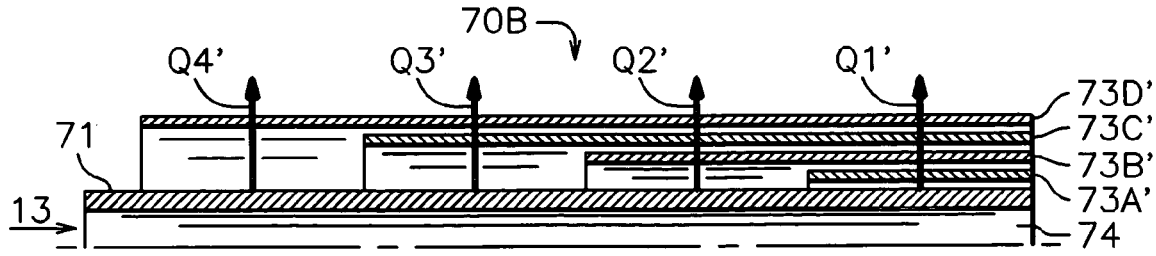
FIG. 11*b* shows the heat-loss distribution for an optimum distribution of radiation shielding.

The concept upon which the present invention is based is illustrated in FIG. 11*b*, in which hollow cathode 70B is shown. Radiation shields 73A', 73B', 73C', and 73D' vary in length, with the shortest being closest to tantalum tube 71 and the longest being farthest from that tube. For the proper selection of radiation shield lengths, the radiative heat-transfer intensity through inner shield 73A', Q1', to shield 73B' is approximately equal to the radiative heat-transfer intensity direct from tube 71 to shield 73B', Q2'. With the heat-transfer intensities in these two regions approximately equal, there is no significant temperature difference over the length of shield 73B'. In a similar manner, there are no significant temperature differences in shields 73C' and 73D'. A comparison of the heat flows shown in FIGS. 11*a* and 11*b* thus results in the unexpected conclusion that removing excess lengths of inner radiation shields should reduce or eliminate the unnecessary cooling that results from those excess lengths, and should thus improve the radiation-shield efficiency.

Shields 73A', 73B', 73C', and 73D' increase in length from the open end of tube 71 in sequential order outward from hollow tantalum tube 71. That is, the inner shields (the shields closer to tantalum tube 71) are shorter than the outer shields (the shields farther from the tantalum tube). It should be apparent much or most of the benefit of the present invention can be obtained if the increase in length of these shields is approximately in sequential order, rather than strict sequential order. For example, several successive shields can have the same length without greatly compromising the overall thermal efficiency of the shields. In fact, such a construction was used in the preferred embodiment of FIG. 8, with first plurality of shields 72A all of the same length, and second plurality of shields 72B all of a second and longer length than shields 72A.

It may appear that conduction in radiation shields parallel to the tube shouldn't be a problem with a shield material as thin as 0.013 mm, the thinnest readily available thickness of tantalum foil. The preferred embodiment, however, has two pluralities of concentric shields, each with 15 layers of this material, making a total radial thickness of shield material approximately equal to the tube thickness of 0.038 mm. When the larger mean radii of the heat shields are considered, it is evident that the cross section for heat transfer parallel to the tantalum tube within these shields is actually greater than that in the tube, despite the small, 0.013-mm thickness of the shield material.

The spiral method of construction permits many more radiation shields in a given radial distance than if each layer were a thin tube that had to be slid in place over the next inner tube, and adequate clearance for this method of assembly provided between each pair of adjacent shields. Thermal conduction along the spiral path, however, can be significant under certain circumstances, generally increasing in importance relative to the radiation as the diameter to be enclosed decreases and the shield temperature decreases. For the cathode and shield diameters considered herein, radiation between layers is more important than conduction along the spiral path for shield temperatures greater than about 1200 K.

While a thorough calculation of a multi-shield configuration can be used to optimize radiation-shield performance, a simple two-plurality shield configuration similar to that shown in the preferred embodiment can be effective, increasing the lifetime by more than a factor of ten. As is shown in the next section, even a single plurality of shields extending for about half the tube length can increase the lifetime by a factor of six.

When compared to the prior-art configuration of the HCES 5000, the preferred embodiment showed an excellent ability to withstand repeated exposure to atmosphere. During the test of more than 600 hours, the cathode was removed from the vacuum environment and exposed to the atmosphere six times for examination and measurements. No degradation of the flow passage was observed due to this repeated exposure to atmosphere. Other tests of alternate embodiments with more exposures to atmosphere also support this resistance to atmospheric degradation.

Still comparing the preferred embodiment to the HCES 5000, a tantalum tube with a smaller diameter can be used while still providing the same internal diameter of emission surface. Tantalum is expensive and the smaller diameter permits a cost saving. It also reduces the heat loss to the cathode holder and reduces the power required to heat to operating temperature and start operation.

The preferred embodiment thus demonstrated the resistance to atmospheric exposure that would be expected from the simple refractory-metal tube of Delcroix, et al., while at the same time having an operating lifetime more than ten times longer.

Effect of Shielding Length

A technical person skilled in the art would normally expect the use of more shielding material to result in better thermal shielding. The technical viewpoint discussed in connection with FIGS. 11*a* and 11*b* is that thermal performance can be improved by removing some of the heat shields. This viewpoint is unexpected. Tests were therefore made to demonstrate the validity of this viewpoint. The tantalum tubes used in these tests all had the same dimensions (1.57 mm in outside diameter, a wall thickness of 0.38 mm, and 38 mm long) as the tube used in the 60 hour lifetime test described in the Description of Prior Art. The operating conditions, starting and operating gas flows (argon), and failure to restart as a definition of end of life were also the same.

The maximum length available for heat shields between the cathode holder and the open end of the tantalum tube was 29 mm. A single plurality of radiation shields was used, with an axial length of 29 mm. (The thermal contact of the cathode holder on the tantalum tube was closer to the end of the 38 mm long tube, but a nut on the union fitting that comprised the cathode holder prevented the use of longer heat shields.) The plurality of shields was comprised of 15 turns of 0.013-mm-thick tantalum foil, dimpled by pressing against 60-grit abrasive paper before winding. Except that the maximum length of single-plurality of radiation shields 72A was used, this hollow-cathode configuration was the same as hollow cathode 90 in FIG. 12. The lifetime with this maximum-length plurality of radiation shields was 170 hours. The keeper voltage was 15-16 V over most of the lifetime, being lower than the 16-17 V of the simple unshielded tantalum tube, but higher than the 13-15 V of the preferred embodiment.

Figure 12:
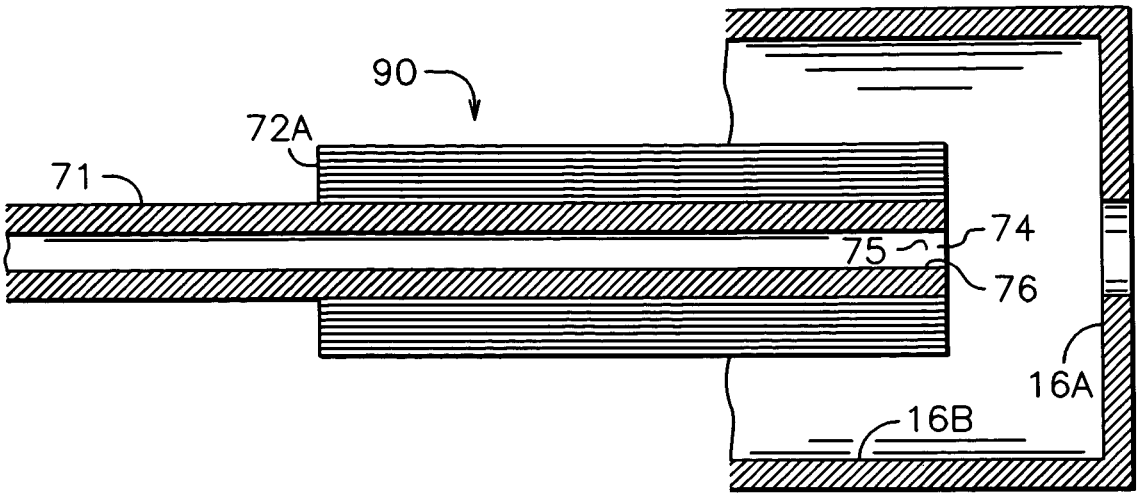
FIG. 12 is a cross section of another embodiment of the present invention.

Another cathode was fabricated similar to hollow cathode 90 shown in FIG. 12, except that the length of single-plurality of heat shields 72A was 20 mm, approximately half the 38 mm length of the tantalum tube. The lifetime for this configuration was 370 hours, more than six times the lifetime with no heat shield. The keeper voltage was 14-16 V over most of the lifetime. The more than doubled lifetime compared to the maximum-length heat shields clearly supported the unexpected viewpoint that removing portions of the heat shields could improve thermal performance.

DESCRIPTION OF ALTERNATE EMBODIMENTS

Referring to FIG. 12, there is shown hollow cathode 90, an alternate embodiment of the present invention. Hollow cathode 90 is generally similar to the preferred embodiment, hollow cathode 70, except that single-plurality of radiation shields 72A was used, with an axial length of 20 mm, comprised of 15 turns of 0.013-mm-thick tantalum foil, and dimpled by pressing against 60-grit abrasive paper before winding. This is the configuration also described in the preceding section. Although the lifetime was shorter than that of the preferred embodiment, it was still six times as long as the simple tubular configuration of Delcroix, et al., hence long enough to be useful in many industrial applications.

Figure 13:
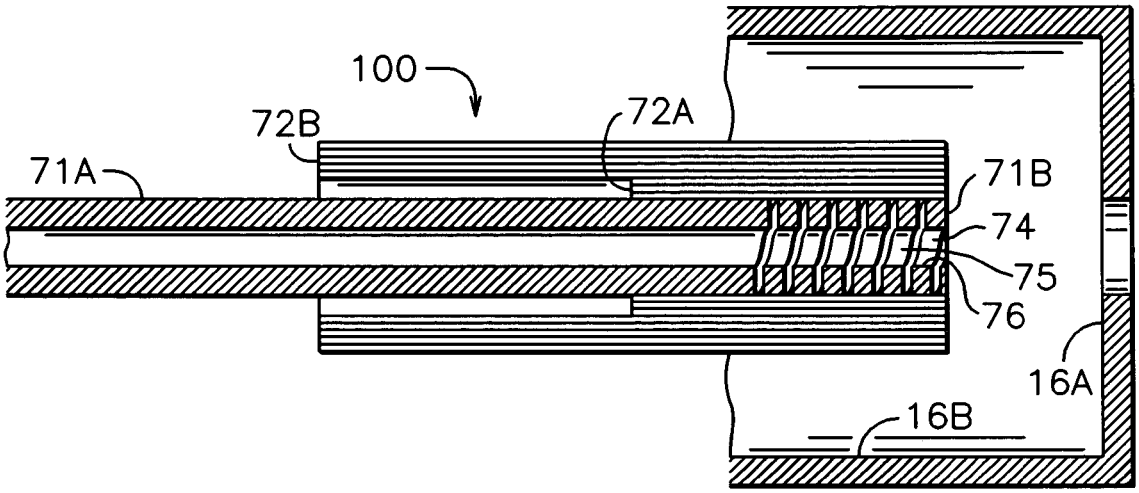
FIG. 13 is a cross section of yet another embodiment of the present invention.

Referring to FIG. 13, there is shown hollow cathode 100, another alternate embodiment of the present invention. Hollow cathode 100 is generally similar to the preferred embodiment, hollow cathode 70, except that tantalum tube 71 in hollow cathode 70 is comprised of unmodified tantalum tube portion 71A and helically slit tube end 71B near tube aperture 74. It is recognized that the power losses of a hollow cathode are comprised of both thermal conduction and radiation losses. The helical slit reduces the thermal conduction between hottest portion of the tantalum tube 71B and unmodified tantalum tube 71A, thereby reducing the overall losses of the hollow cathode.

It should also be apparent that one or more axial breaks could have been used to reduce thermal conduction in the tantalum tube near the hot end, rather than a helical slit.

Figure 14:
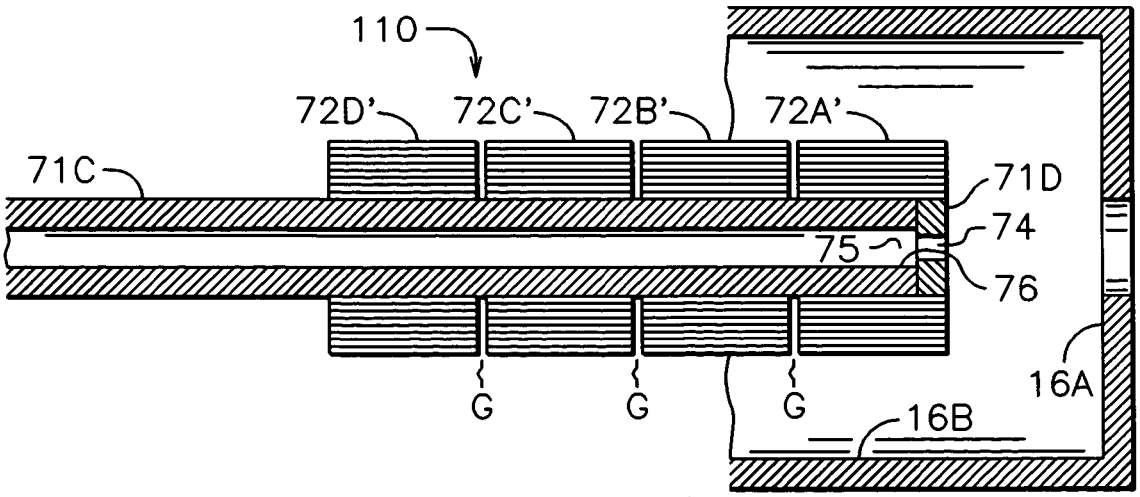
FIG. 14 is a cross section of still another embodiment of the present invention.

Referring to FIG. 14, there is shown yet another alternate embodiment of the present invention. Hollow cathode 110 incorporates two features that differ from the preferred embodiment. Tantalum tube 71C has a tungsten tip 71D, which can be either in contact with tube 71C or welded to it. Tip 71D has aperture 74 which is smaller than the internal diameter of tube 71C, so that a pressure of about one Torr can be maintained in volume 75 near the aperture at a reduced flow of working gas. The thicker wall of tip 71D compared to tube 71C also permits it to better withstand the bombardment of ions formed external to the hollow cathode.

An alternate means of restricting the loss of ionizable working gas would be to reduce the size of the aperture at the end of the tantalum tube by shaping or forming the tantalum tube, rather than by introducing a separate tip 71D. Other changes in diameter or wall thickness could be considered for the tantalum tube, if they could be incorporated at reasonable expense.

The other feature in FIG. 14 that differs from the preferred embodiment is the construction of the radiation shields. To reduce the conduction in the heat shields parallel to the tantalum tube, the radiation shields are axially segmented into pluralities of shields 72A', 72B', 72C', and 72D', with gaps G between the segments. If preferred, the gaps may be partial rather than complete. That is, the pluralities of shields 72A', 72B', 72C', and 72D' may be formed from a single sheet of foil, with perforations at the junctions of segments rather than complete breaks. The reduced conduction due to these perforations will be considered herein to be equivalent to making complete breaks between segments. In deciding between the heat-shield configurations of FIGS. 13 and 14, the radiation losses from the tantalum tube out through gaps G will have to be evaluated.

The radiation shields of several embodiments of the present invention were examined following completion of the duration test. Only the outer shields of the outer radiation-shield plurality retained normal flexibility and could be unrolled to any extent. Other shields were either welded together by the heat or sufficiently brittle that they could not be unrolled. Any possibility of flaking was apparently prevented by brittle radiation shields being held between the thicker tantalum tube and the relatively unaffected outer layers of the heat shield. Exposure of the thin radiation shields to atmosphere thus appears to have minimal adverse effects.

Tantalum was the tube material used in several embodiments herein. Alternate tube materials include molybdenum, niobium, rhenium, tungsten, alloys of tantalum or these metals, or carbon. Tantalum foil was the radiation-shield material used herein. The same materials used for the tube could also be used for the radiation shield. Because the radiation shields do not need to be electrically conductive, foils of other refractory materials such as alumina, mica, or quartz could be used for those shields that operate at low enough temperatures. A foil is herein defined as being a flat, sheet-like material that is about 0.1-0.2 mm thick, or less. Thicker material could be used, but would increase thermal conduction in the axial direction, and would increase thermal conduction from shield to shield when a spiral winding is used for the shields.

Igniter/keeper 16 (or 16A and 16B) has been used in the embodiments shown in FIGS. 8, 9, 12, 13, and 14. As described in the prior-art discussion with FIG. 3, the starting function can be carried out using the anode 18 instead of igniter/keeper 16. When this is done, a high-voltage starting circuit (at least several hundred volts and typically of the order of 1 kV) is incorporated into discharge power supply 24 instead of igniter/keeper power supply 23. For starting, the general requirement is for an electrode located external to the open end of the hollow cathode to be energized positive to that hollow cathode by a power supply, with no restriction on whether the electrode is an igniter/keeper or an anode and whether the power supply is an igniter/keeper power supply or a discharge supply.

Figure 15:
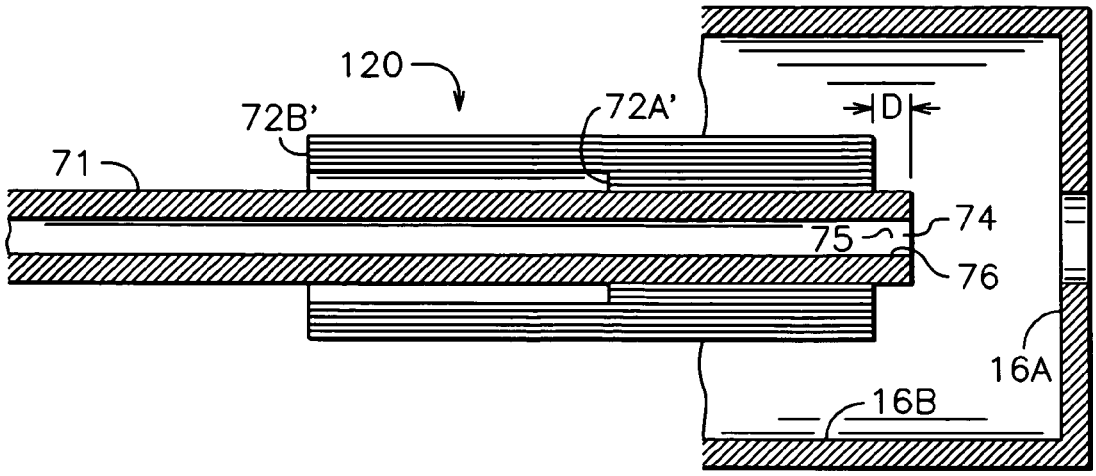
FIG. 15 is a cross section of still yet another embodiment of the present invention.
Figure 16:
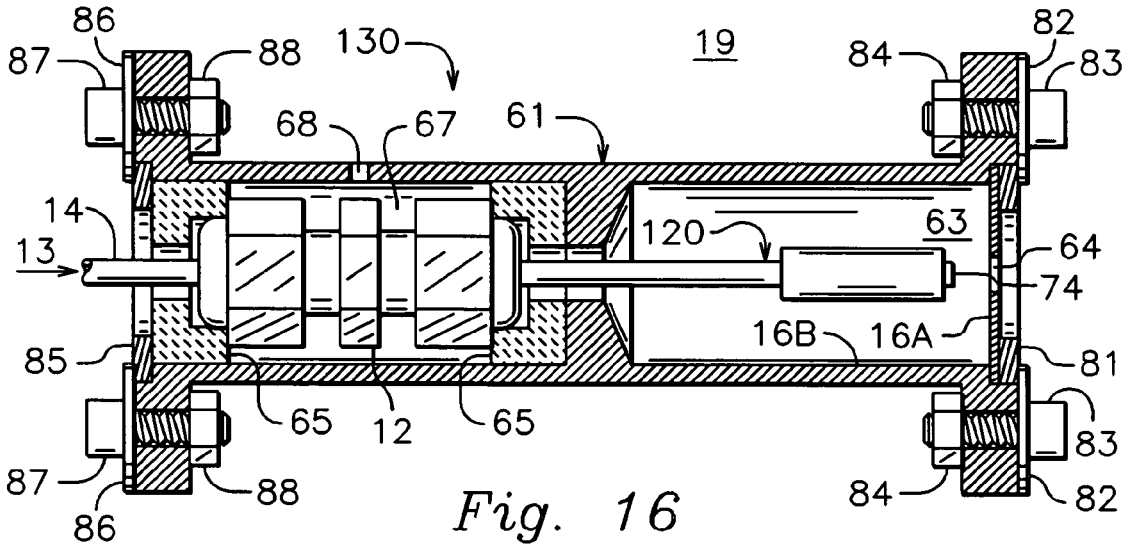
FIG. 16 shows a hollow-cathode assembly incorporating the embodiment of the present invention shown in FIG. 15.

Hollow-cathode assemblies have been described in which a discharge between the hollow cathode and the surrounding enclosed keeper is used to heat the hollow cathode to operating temperature (see FIGS. 8 and 9). To improve ease of starting for such hollow cathodes, it can be helpful to have the radiation shields end at a small distance back from the open end of the tantalum tube, rather than flush with that open end. As an example, see hollow cathode 120 in FIG. 15 and hollow-cathode assembly 130 in FIG. 16, where distance D is the distance back from the open end at which pluralities of shields 72A' and 72B' end. Typically, distance D is about equal to the diameter of tube 71 or less, and never more than twice that diameter. Other than the displacement of the end of the shields, D, the parts and the description of starting and operation are the same for FIGS. 15 and 16 as for the preferred embodiment of FIGS. 8 and 9. There is some initial increase in heat loss due to the increased surface exposure of high-temperature tantalum tube 71. However, because the ends of pluralities of heat shields 72A' and 72B' are further from the intense discharge near the open end of tantalum tube 71, the damage to the heat shields is reduced due to displacement, D, and the overall effect of this displacement on heat loss and cathode lifetime is small.

Figure 17:
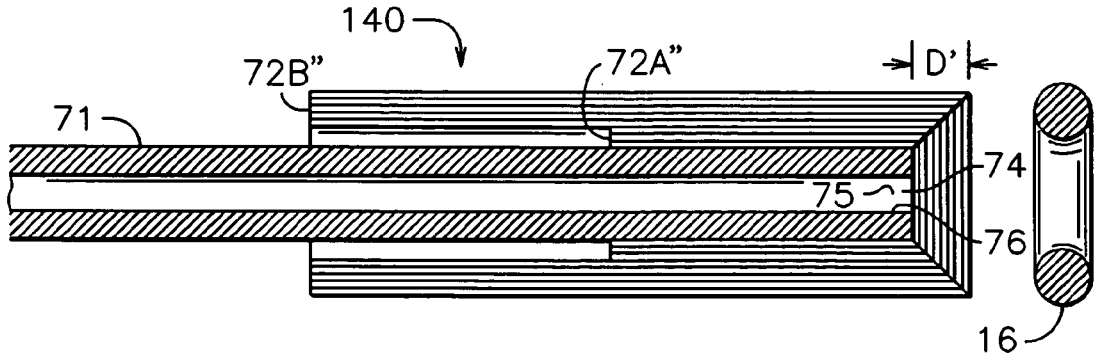
FIG. 17 is a cross section of a further embodiment of the present invention.

Alternatively, it may be useful to have the shields end beyond the open end of the tantalum tube, as shown in FIG. 17. Such a configuration could, for example, be useful in containing the flow of gas leaving the hollow cathode, and thereby promoting the starting of a discharge between the hollow cathode and a non-enclosed keeper 16 as shown in FIG. 17. (A non-enclosed keeper is also shown in prior-art FIGS. 4 and 5.) The maximum distance D' of this extension of inner and outer pluralities of heat shields 72A" and 72B" would typically be about equal to the diameter of tube 71 or less, and never more than twice that diameter.

Figure 18:
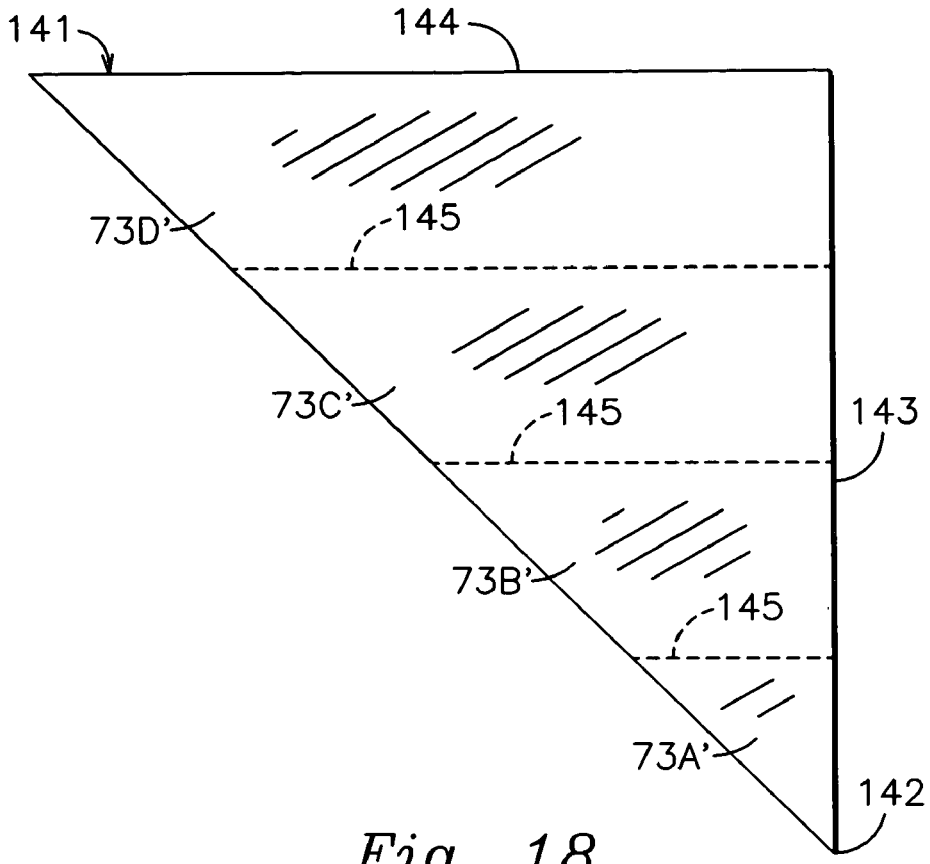
FIG. 18 shows the plan view (normal to the surface) of a piece of refractory foil shaped to fabricate into a spiral, multiple-turn winding similar to the plurality of radiation shields shown in FIG. 11*b*.

The shaping of refractory foil for spiral, multiple-turn windings that comprise a plurality of radiations shields is indicated in FIG. 18. Foil shape 141 is suited for the plurality of shields shown in FIG. 11*b*. Point 142 is placed in contact with the cylindrical surface of cathode tube 71 near the open end. If desired, the foil near point 142 can be spot-welded or otherwise attached to the cathode tube. The foil is then rolled around the cathode tube, keeping edge 143 close to the open end, and ending up with edge 144 on the outside of the spiral, multiple-turn winding. The multiple-turn winding may be held in place on the cathode tube by mechanical external restraint, such as a wire with the ends twisted together. Alternatively, small spot welds can fasten together the outer several heat shields and prevent unrolling. Radiation shields 73A', 73B', 73C', and 73D' in FIG. 11*b* are formed from the portions of foil indicated by 73A', 73B', 73C', and 73*d*' and separated by dashed lines 145 in FIG. 18.

Figure 19:
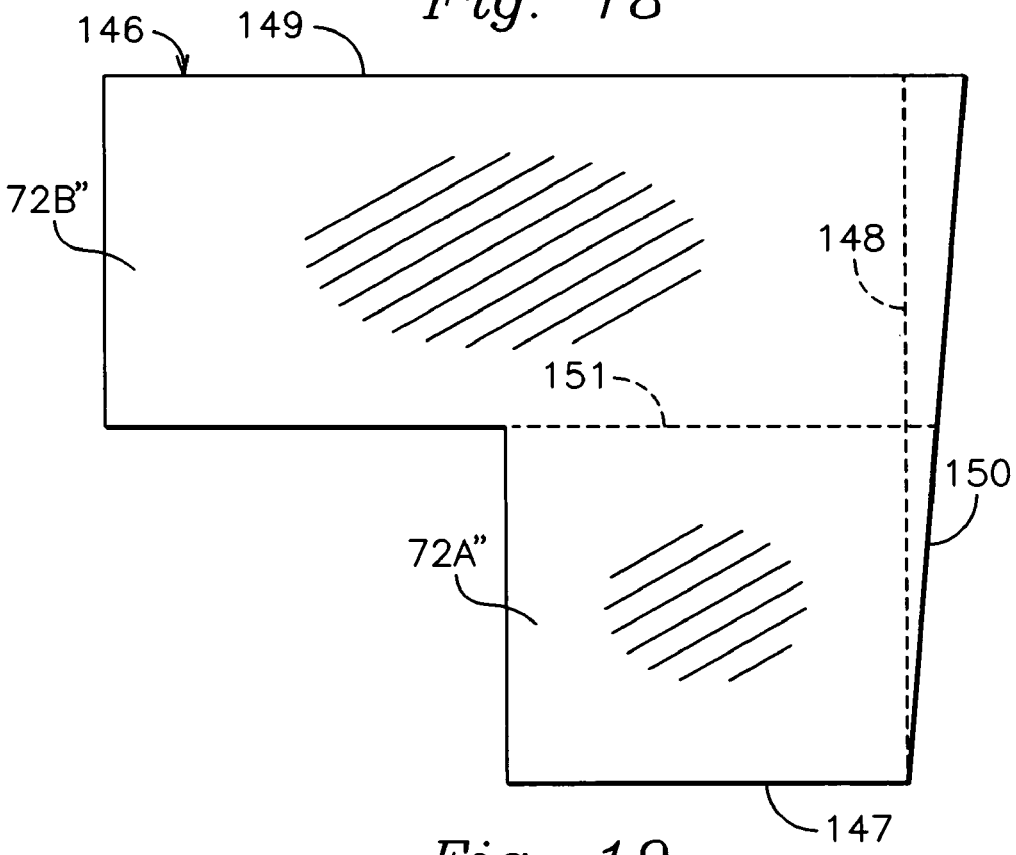
FIG. 19 shows the plan view of a piece of refractory foil shaped to fabricate into a spiral, multiple-turn winding similar to the plurality of radiation shields shown in FIG. 17.

Another example of the shaping of refractory foil for spiral, multiple-turn shield windings is indicated in FIG. 19. Foil shape 146 is suited for the plurality of shields shown in FIG. 17. Edge 147 is placed in contact with the cylindrical surface of cathode tube, parallel to the axis of the tube, and with the intersection of edge 147 and dashed line 148 near the open end. The foil is then rolled around the cathode tube, keeping dashed line 148 close to the open end, and ending up with edge 149 on the outside of the spiral, multiple-turn winding. Pluralities of radiation shields 72A" and 72B" in FIG. 17 are formed from the portions of foil indicated by 72A" and 72B" and separated by dashed line 151 in FIG. 19. Edge 150 forms the extensions of the radiation shields beyond the open end of cathode tube 71. Other means of shaping foil to achieve a desired radiation shield configuration when used in a spiral, multiple-turn winding should be readily apparent.

The heating means for the cathode to reach operating temperature in the preferred embodiment is a discharge between the cathode and igniter/keeper. Other heating means could be used. For example, the heating means could also be a discharge between the cathode and the anode. Or, alternatively, the heating means could also use a metallic resistive heater, as described in the Prior Art Section.

While particular embodiments of the present invention have been shown and described, and various alternatives have been suggested, it will be obvious to those of ordinary skill in the art that changes and modifications may be made without departing from the invention in its broadest aspects. Therefore, the aim in the appended claims is to cover all such changes and modifications as fall within the true spirit and scope of that which is patentable.

We claim:

1. A hollow-cathode apparatus comprising:

a refractory-metal hollow tube having first and second ends;

an opening for introducing an ionizable working gas to said first end of said tube;

a plurality of concentric radiation shields surrounding said hollow tube; wherein all shields of said plurality end approximately at said second end of said tube and the lengths of said shields increase in approximate sequential order outward from said tube; and wherein said radiation shields are adjacent to each other and are supported by said hollow tube without intervening support structure between said tube and said shields.

2. A hollow-cathode apparatus comprising:

a refractory-metal hollow tube having first and second ends;

an opening for introducing an ionizable working gas to said first end of said tube;

a plurality of concentric radiation shields surrounding said hollow tube; wherein all shields of said plurality end approximately at said second end of said tube and wherein at least one shield is shorter than another that is farther from said tube than said one shield; and wherein said radiation shields are adjacent to each other and are supported by said hollow tube without intervening support structure between said tube and said shields.

3. A hollow-cathode apparatus comprising:

a refractory-metal hollow tube, without an emissive insert, said hollow tube having first and second ends;

an opening for introducing an ionizable working gas to said first end of said tube;

heating means for increasing the temperature of said tube near said second end; wherein said heating means comprises a discharge between a cathode and an igniter/keeper or between a cathode and an anode;

a radiation shield surrounding said hollow tube without intervening support structure between said tube and said shield; wherein said shield ends at approximately said second end of said tube and has a length not exceeding approximately half the length of said tube.

4. A hollow-cathode apparatus comprising:

a refractory-metal hollow tube having first and second ends;

a means for supporting said first end of said tube;

a means for introducing an ionizable working gas to said first end of said tube;

an electrode located external to said second end of said tube;

a heating means for increasing the temperature of said tube near said second end; and a plurality of concentric radiation shields surrounding said hollow tube; wherein all shields of said plurality end approximately at said second end of said tube and the lengths of said shields increase in approximate sequential order outward from said tube; and wherein said radiation shields are adjacent to each other and are supported by said hollow tube without intervening support structure between said tube and said shields.

5. A hollow-cathode apparatus as defined in claim 4 wherein at least some of said radiation shields comprise a spiral winding of refractory foil.

6. A hollow-cathode apparatus comprising:

a refractory-metal hollow tube having first and second ends;

a means for supporting said first end of said tube;

a means for introducing an ionizable working gas to said first end of said tube;

an electrode located external to said second end of said tube;

a heating means for increasing the temperature of said tube near said second end; and a plurality of concentric radiation shields surrounding said hollow tube; wherein all shields of said plurality end approximately at said second end of said tube and wherein at least one shield is shorter than another that is farther from said tube than said one shield; and wherein said radiation shields are adjacent to each other and are supported by said hollow tube without intervening support structure between said tube and said shields.

7. A hollow-cathode apparatus as defined in claim 6 wherein at least some of said radiation shields comprise a spiral winding of refractory foil.

8. A hollow-cathode apparatus comprising:

a refractory-metal hollow tube, without an emissive insert, said hollow tube having first and second ends;

a means for supporting said first end of said tube;

a means for introducing an ionizable working gas to said first end of said tube;

an electrode located external to said second end of said tube;

a heating means for increasing the temperature of said tube near said second end; wherein said heating means comprises a discharge between a cathode and an igniter/keeper or between a cathode and an anode; and a radiation shield surrounding said hollow tube without intervening support structure between said tube and said shield; wherein said shield ends at approximately said second end of said tube and has a length not exceeding approximately half the length of said tube.

9. A hollow-cathode apparatus as defined in claims 4 through 8 wherein the material of the refractory-metal tube comprises tantalum.

10. A hollow-cathode apparatus as defined in claims 4 through 8 wherein the radiation-shield material comprises tantalum foil.

11. A hollow-cathode apparatus as defined in claims 4 through 8 wherein said electrode comprises an anode means.

12. A hollow-cathode apparatus as defined in claims 4 through 8 wherein said electrode comprises an enclosed igniter/keeper.

* * * * *